US009051648B2

(12) United States Patent
Fujikawa et al.

(10) Patent No.: US 9,051,648 B2
(45) Date of Patent: Jun. 9, 2015

(54) SUBSTRATE PROVIDED WITH METAL NANOSTRUCTURE ON SURFACE THEREOF AND METHOD OF PRODUCING THE SAME

(75) Inventors: Shigenori Fujikawa, Wako (JP); Mari Koizumi, Wako (JP); Takahiro Senzaki, Kawasaki (JP); Takahiro Dazai, Kawasaki (JP); Ken Miyagi, Kawasaki (JP)

(73) Assignees: Riken, Wako-shi (JP); Tokyo Ohka Kogyo Co., Ltd., Kawasaki-shi (JP)

( * ) Notice: Subject to any disclaimer, the term of this patent is extended or adjusted under 35 U.S.C. 154(b) by 163 days.

(21) Appl. No.: 13/218,168

(22) Filed: Aug. 25, 2011

(65) Prior Publication Data

US 2012/0048738 A1 Mar. 1, 2012

(30) Foreign Application Priority Data

Aug. 31, 2010 (JP) ..... 2010-194831

(51) Int. Cl.
*C23C 18/54* (2006.01)

(52) U.S. Cl.
CPC ..... *C23C 18/54* (2013.01)

(58) Field of Classification Search
CPC ..... C23C 18/54
USPC ..... 205/85, 135
See application file for complete search history.

(56) References Cited

U.S. PATENT DOCUMENTS

2002/0004180 A1 1/2002 Hotta et al.
2003/0185741 A1 10/2003 Matyjaszewski et al.
2006/0141159 A1* 6/2006 Okuda et al. ..... 427/331
2006/0249784 A1* 11/2006 Black et al. ..... 257/327
2007/0190284 A1* 8/2007 Park ..... 428/66.4
2008/0037101 A1* 2/2008 Jagannathan et al. ..... 359/286
2009/0087664 A1* 4/2009 Nealey et al. ..... 428/411.1
2010/0147796 A1 6/2010 Kubo et al.

(Continued)

FOREIGN PATENT DOCUMENTS

JP A-2001-151734 6/2001
JP A-2001-345537 12/2001

(Continued)

OTHER PUBLICATIONS

Wang et al.; "Nanostructured Gold Films for SERS by Block Copolymer-Templated Galvanic Displacement Reactions;" *Nano Letters*, vol. 9, No. 6, pp. 2384-2389, 2009.

(Continued)

*Primary Examiner* — Bryan D. Ripa
(74) *Attorney, Agent, or Firm* — Knobbe Martens Olson & Bear LLP

(57) ABSTRACT

A method of producing a substrate provided with a metal nanostructure on the surface thereof, including: forming a layer containing a block copolymer having a plurality of polymers bonded on a surface of a substrate, and subjecting the layer to phase separation, selectively removing a phase of at least one polymer of the plurality of copolymers constituting the block copolymer from the layer to expose part of the surface of the substrate, and allowing a metal ion to come into contact with the exposed surface of the substrate to effect an electrochemical reaction between the surface of the substrate and the metal ion, thereby depositing a metal on the surface of the substrate; and a substrate provided with a metal nanostructure on the surface thereof produced by the same method.

3 Claims, 3 Drawing Sheets

(56) References Cited

U.S. PATENT DOCUMENTS

| | | | | |
|---|---|---|---|---|
| 2010/0151188 | A1 | 6/2010 | Ishizuka et al. | |
| 2011/0278533 | A1 * | 11/2011 | Hillhouse et al. | 257/9 |

FOREIGN PATENT DOCUMENTS

| | | |
|---|---|---|
| JP | A-2005-500229 | 1/2005 |
| JP | A-2006-240902 | 9/2006 |
| JP | A-2008-036491 | 2/2008 |
| JP | A-2008-134599 | 6/2008 |
| JP | A-2010-142881 | 7/2010 |
| JP | A-2010-285686 | 12/2010 |

OTHER PUBLICATIONS

Aizawa et al.; "Block Copolymer Templated Chemistry for the Formation of Metallic Nanoparticle Arrays on Semiconductor Surfaces;" *Chemistry of Materials*, vol. 19, No. 21, pp. 5090-5101, 2007.

Aizawa et al.; "Nanoscale Patterning of Two Metals on Silicon Surfaces Using an ABC Triblock Copolymer Template;" *Journal of the American Chemical Society*, vol. 128, No. 17, pp. 5877-5886, 2006.

Jinan Chai et al., Assembly of aligned linear metallic patterns on silicon, Nature Nanotechnology, Aug. 3, 2007, vol. 2, pp. 500-506.

Koji Asakawa, Block Copolymer Lithography and Applications to Electronic Devices, Journal of the Japanese Association for Crystal Growth vol. 36, No. 1, pp. 37-43, Apr. 2009.

Kaori Ito, Construction of Perpendicularly-Oriented Nanocylinder Structure in Amphiphilic Liquid Crystalline Block Copolymer Thin Films, Journal of the Japanese Association for Crystal Growth vol. 36, No. 1, pp. 30-36, Apr. 2009.

Jannis W, Ochsmann et al., PS-b-PEO block copolymer thin films as structured reservoirs for nanoscale precipitation reactions, Journal of Polymer Science Part B: Polymer Physics, 2010, vol. 48, No. 14, pp. 1569-1573.

Office Action in Japanese Patent Application No. 2010-194831, mailed Aug. 12, 2014.

* cited by examiner

SUBSTRATE PROVIDED WITH METAL NANOSTRUCTURE ON SURFACE THEREOF AND METHOD OF PRODUCING THE SAME

TECHNICAL FIELD

The present invention is related to a method of producing a substrate provided with a metal nanostructure on the surface thereof by using phase separation of a block copolymer and galvanic displacement reaction, and a substrate provided with a metal nanostructure on the surface thereof produced by the same method.

Priority is claimed on Japanese Patent Application No. 2010-194831, filed Aug. 31, 2010, the content of which is incorporated herein by reference.

BACKGROUND ART

In recent years, techniques for fabricating microscopic structures have been expected to be applicable to a wide variety of fields. In particular, structural bodies that include structures of nanometer size (so-called nanomaterials) exhibit different optical, electrical and magnetic properties from their corresponding bulk materials, and are therefore attracting enormous interest, both from the fundamental research perspective and the applied research perspective. For example, nanomaterials having a hollow three dimensional structure such as a cylindrical shape are expected to have important roles in a variety of different fields, including inclusion chemistry, electrochemistry, materials science, biomedicine, sensors, catalysts and separation techniques. Furthermore, techniques for fabricating line-shaped micropatterns can be linked directly to the fabrication of integrated circuits and increased integration levels, and are therefore the subject of extremely intensive research and development in fields such as the semiconductor industry.

As a method of fabricating microscopic structures, a method using lithography method is known. However, in a photo/electron beam lithography method, a large number of processes such as formation of a metal film, patterning and etching are required, which makes the method complicated. Therefore, a method of fabricating a metal structure has been demanded which is more simple with large area and controlled size and shape.

On the other hand, in recent years, a method has been disclosed in which a fine pattern is formed using a phase-separated structure formed from a block copolymer having mutually incompatible polymers bonded together (see Patent Document 1). Also, methods have been reported in which metal nanostructures are produced by a metal deposition method or an electroplating method using a nano pattern formed by utilizing a phase-separated structure as a template.

Among these, as a method of producing a metal nanostructure using a phase separation of a block copolymer and a galvanic displacement reaction, a method is known in which metal ions are captured in micelles formed from a block copolymer to thereby produce a metal nanostructure (see Non-Patent Documents 1 to 3).

DOCUMENTS OF RELATED ART

Patent Document

[Patent Document 1] Japanese Unexamined Patent Application, First Publication No. 2008-36491

[Non-Patent Document]

[Non-Patent Document 1] Wang et al., Nano Letters, 2009, Vol. 9, No. 6, pp. 2384-2389

[Non-Patent Document 2] Aizawa et al., Chemistry of Materials, 2007. Vol. 19, No. 21, pp. 5090-5101

[Non-Patent Document 3] Aizawa et al., Journal of the American Chemical Society, 2006, Vol. 128, No. 17, pp. 5877 to 5886

SUMMARY OF THE INVENTION

In the methods described in Non-Patent Documents 1 to 3, since the metal nanostructure is formed within the micelles of the block copolymer, the nanostructure is limited to a spherical structure. Further, in principle, it is impossible to form a structure with a high aspect ratio from a spherical structure. Thus, these methods posed problems in that the freedom of the shape of the formed metal nanostructure was low.

The present invention takes the above circumstances into consideration, with an object of providing a method of forming a substrate provided with a metal nanostructure on the surface thereof using the phase separation of a block copolymer and a galvanic displacement reaction, in which the metal nanostructure is designed more freely with respect to the shape and the size thereof.

For solving the above-mentioned problems, the present invention employs the following aspects.

Specifically, a first aspect of the present invention is a method of producing a substrate provided with a metal nanostructure on the surface thereof, including: forming a layer containing a block copolymer having a plurality of polymers bonded on a surface of a substrate, and subjecting the layer to phase separation, selectively removing a phase of at least one polymer of the plurality of copolymers constituting the block copolymer from the layer to expose part of the surface of the substrate, and allowing a metal ion to come into contact with the exposed surface of the substrate to effect an electrochemical reaction between the surface of the substrate and the metal ion, thereby depositing a metal on the surface of the substrate.

A second aspect of the present invention is a substrate provided with a metal nanostructure on the surface thereof produced by the method according to the first aspect.

According to the present invention, there is provided a method of forming a substrate provided with a metal nanostructure on the surface thereof in which the metal nanostructure is designed more freely with respect to the shape and the size thereof.

DETAILED DESCRIPTION OF THE INVENTION

Figure 1:
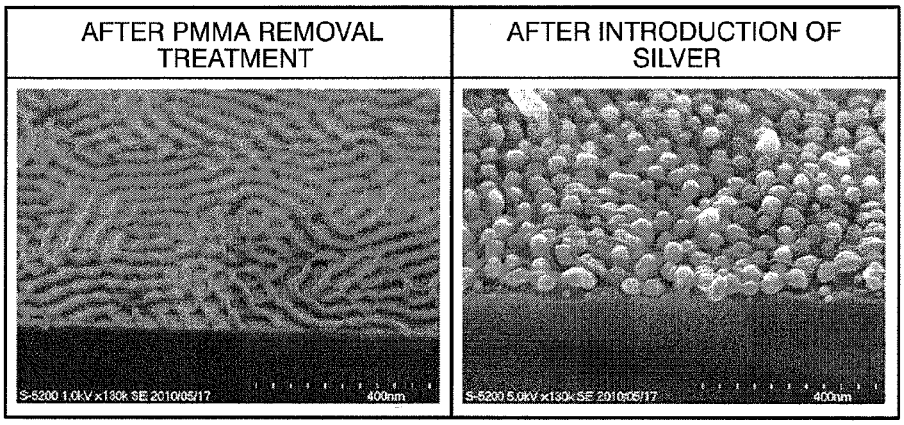
FIG. 1 is a scanning electron microscope image of the surface of the silicon wafer in Example 1.

<<Method of Producing a Substrate Provided with a Metal Nanostructure on the Surface Thereof>>

The method of producing a substrate provided with a metal nanostructure on the surface thereof according to the present invention includes a step of forming a layer containing a block copolymer having a plurality of polymers bonded on a surface of a substrate, and subjecting the layer to phase separation, a step of selectively removing a phase of at least one polymer of the plurality of copolymers constituting the block copolymer from the layer to expose part of the surface of the substrate, and a step of allowing a metal ion to come into contact with the exposed surface of the substrate to effect an electrochemical reaction between the surface of the substrate and the metal ion, thereby depositing a metal on the surface of the substrate.

The layer containing the block polymer having a plurality of polymers bonded can be separated into phases containing the respective polymers as a main component by phase separation. In the present invention, one or a plurality of phases within the phase-separated structure are selectively removed such that at least one phase remains within the phase-separated structure, thereby exposing only the surface of the substrate where the removed phase was formed. Then, a metal nanostructure is formed only on the exposed surface. Therefore, the size and the shape of the metal nanostructure on the surface of the substrate are determined by the size and the shape of the phase selectively removed from the phase-separated structure of the layer containing the block copolymer. In other words, by appropriately adjusting the size and shape of the phase-separated structure to be formed on the surface of the substrate, a metal nanostructure having the desired shape and size can be formed on the surface of the substrate. In particular, by using a phase-separated structure capable of forming a finer pattern than conventional resist patterns as a template, it becomes possible to form a substrate provided with a metal nanostructure having an extremely minute shape.

Hereafter, each of the steps and the materials used will be explained in detail.

<Block Copolymer>

A block copolymer is a polymeric material in which plurality of polymers are bonded. As the polymers constituting the block copolymer, 2 types of polymers may be used, or 3 or more types of polymers may be used.

In the present invention, the plurality of polymers constituting the block copolymer are not particularly limited, as long as they are combinations capable of causing phase separation. However, it is preferable to use a combination of polymers which are mutually incompatible. Further, it is preferable to use a combination in which a phase of at least one polymer amongst the plurality of polymers constituting the block copolymer can be easily subjected to selective removal as compared to the phases of other polymers.

Examples of the block copolymer include a block copolymer having a polymer with a structural unit of styrene or a derivative thereof bonded to a polymer with a structural unit of a (meth)acrylate ester, a block copolymer having a polymer with a structural unit of styrene or a derivative thereof bonded to a polymer with a structural unit of a siloxane or a derivative thereof, and a block copolymer having a polymer with a structural unit of an alkylene oxide bonded to a polymer with a structural unit of a (meth)acrylate ester. The term "(meth) acrylate ester" is a generic term that includes either or both of the acrylate ester having a hydrogen atom bonded to the α-position and the methacrylate ester having a methyl group bonded to the α-position.

As the (meth)acrylate ester, for example, (meth)acrylic acid having a substituent such as an alkyl group or a hydroxyalkyl group bonded to the carbon atom of the (meth)acrylic acid can be used. Examples of the alkyl group as the substituent include linear, branched or cyclic alkyl groups of 1 to 10 carbon atoms. Specific examples of the (meth)acrylate ester include methyl (meth)acrylate, ethyl (meth)acrylate, propyl (meth)acrylate, cyclohexyl (meth)acrylate, octyl (meth)acrylate, nonyl (meth)acrylate, hydroxyethyl (meth)acrylate, hydroxypropyl (meth)acrylate, benzyl (meth)acrylate, anthracene (meth)acrylate, glycidyl (meth)acrylate, 3,4-epoxycyclohexylmethane (meth)acrylate, and propyltrimethoxysilane (meth)acrylate.

Examples of the styrene derivative include α-methylstyrene, 2-methylstyrene, 3-methylstyrene, 4-methylstyrene, 4-t-butylstyrene, 4-n-octylstyrene, 2,4,6-trimethylstyrene, 4-methoxystyrene, 4-t-butoxystyrene, 4-hydroxystyrene, 4-nitrostyrene, 3-nitrostyrene, 4-chlorostyrene, 4-fluorostyrene, 4-acetoxyvinylstyrene, vinylcyclohexane, 4-vinylbenzylchloride, 1-vinylnaphthalene, 4-vinylbiphenyl, 1-vinyl-2-pyrolidone, 9-vinylanthracene, and vinylpyridine.

Examples of the siloxane derivative include dimethylsiloxane, diethylsiloxane, diphenylsiloxane, and methylphenylsiloxane.

Examples of the alkylene oxide include ethylene oxide, propylene oxide, isopropylene oxide and butylene oxide.

In the present invention, it is preferable to use a block copolymer having a polymer with a structural unit of styrene or a derivative thereof bonded to a polymer with a structural unit of a (meth)acrylate ester. Specific examples thereof include a styrene-polymethyl methacrylate (PS-PMMA) block copolymer, a styrene-polyethyl methacrylate block copolymer, a styrene-(poly-t-butyl methacrylate) block copolymer, a styrene-polymethacrylic acid block copolymer, a styrene-polymethyl acrylate block copolymer, a styrene-polyethyl acrylate block copolymer, a styrene-(poly-t-butyl acrylate) block copolymer, and a styrene-polyacrylic acid block copolymer. In the present invention, it is particularly preferable to use a PS-PMMA block copolymer.

The weight average molecular weight (Mw) (the polystyrene equivalent value determined by gel permeation chromatography) of each polymer constituting the block copolymer is not particularly limited as long as it is large enough to cause phase separation. The weight average molecular weight is preferably 5,000 to 500,000, more preferably 10,000 to 400,000, and still more preferably 20,000 to 300,000.

The polydispersity (Mw/Mn) of the block copolymer is preferably 1.0 to 3.0, more preferably 1.0 to 1.5, and still more preferably 1.0 to 1.2. Mn represents the number average molecular weight.

Hereafter, among the polymers constituting the block copolymer, a polymer which is not selectively removed in the later step is referred to as "polymer $P_A$", and a polymer to be selectively removed is referred to as "polymer $P_B$". For example, after the phase separation of a layer containing a PS-PMMA block copolymer, by subjecting the layer to an oxygen plasma treatment or a hydrogen plasma treatment, the phase of PMMA is selectively removed. In such a case, PS is the polymer $P_A$, and PMMA is the polymer $P_B$.

In the present invention, the shape and size of the phase to be selectively removed (i.e., the phase of polymer $P_B$) is determined by the compositional ratio of the respective polymers constituting the block copolymer and the molecular weight of the block copolymer. For example, by making the compositional ratio per volume of the polymer $P_B$ within the block copolymer relatively small, a cylinder structure in which the phase of the $P_B$ polymer is present within the phase of the polymer $P_A$ in the form of a cylinder can be formed. On the other hand, by making the compositional ratio per volume of the polymer $P_B$ within the block copolymer about the same as that of the polymer $P_A$, a lamellar structure in which the phase of the polymer $P_A$ and the phase of the polymer $P_B$ are alternately laminated can be formed. Further, by increasing the molecular weight of the block copolymer, the size of each phase can be increased.

<Substrate>

A substrate forms part of the substrate provided with a metal nanostructure on the surface thereof (metal nanostructure-containing substrate). In the present invention, a substrate in the form of a flat plate and having a electron-donating surface is used. By using a electron donating substrate, an oxidation-reduction reaction (galvanic displacement reaction) can be effected with metal ions. Examples of such a substrate include a silicon wafer and a metal substrate such as copper, chromium, iron or aluminum. Alternatively, a polycarbonate substrate or a glass substrate (quartz glass and the like) provided with an electron donating film such as a silicon thin film may be used, so that a galvanic displacement by a oxidation-reduction reaction can be effected on the surface thereof. Further, in the present invention, the size and the shape of the substrate used is not particularly limited as long as it is a flat plate, and can be appropriately selected depending on the size and the shape of the metal nanostructure-containing substrate to be obtained.

<Substrate Washing Treatment>

Before forming a layer containing a block copolymer, the surface of the substrate may be washed. By washing the surface of the substrate, the neutralization reaction treatment in a later step may be satisfactorily performed.

As the washing treatment, a conventional method may be used, and examples thereof include an oxygen plasma treatment, an ozone oxidation treatment, an acid alkali treatment, and a chemical modification treatment. For example, the substrate is immersed in an acidic solution such as a sulfuric acid/hydrogen peroxide aqueous solution, followed by washing with water and drying. Thereafter, a layer containing a block copolymer can be formed on the surface of the substrate.

<Neutralization Treatment>

A neutralization treatment is a treatment in which the surface of the substrate is modified so as to have affinity for all polymers constituting the block copolymer. By the neutralization treatment, it becomes possible to prevent only phases of specific polymers to come into contact with the surface of the substrate by phase separation. For this reason, before forming a layer containing a block copolymer, it is preferable to perform a neutralization treatment depending on the type of the block copolymer to be used. In particular, in order to form a lamellar structure or a cylinder structure arranged in a perpendicular direction of the surface of the substrate by phase separation, it is preferable to perform a neutralization treatment of the surface of the substrate in advance.

A specific example of the neutralization treatment includes a treatment in which a thin film (neutralization film) containing a base material having affinity for all polymers constituting the block copolymer is formed on the surface of the substrate.

As the neutralization film, a film composed of a resin composition can be used. The resin composition used as the base material can be appropriately selected from conventional resin compositions used for forming a thin film, depending on the type of polymers constituting the block copolymer. The resin composition used as the base material may be a heat-polymerizable resin composition, or a photosensitive resin composition such as a positive resist composition or a negative resist composition.

Alternatively, the neutralization film may be a non-polymerizable film. For example, a siloxane organic monomolecular film such as phenethyltrichlorosilane, octadecyltrichlorosilane or hexamethyldisilazane may be preferably used as a neutralization film.

The neutralization film composed of such base materials can be formed by a conventional method.

Examples of the base material include a resin composition containing all structural units of the polymers constituting the block copolymer, and a resin containing all structural units having high affinity for the polymers constituting the block copolymer.

For example, when a PS-PMMA block copolymer is used, as the base material, it is preferable to use a resin composition containing both PS and PMMA as the structural units, or a compound or a composition containing both a portion having a high affinity for PS such as an aromatic ring and a portion having a high affinity for PMMA such as a functional group with high polarity.

Examples of the resin composition containing both PS and PMMA as the structural units include a random copolymer of PS and PMMA, and an alternating polymer of PS and PMMA (a copolymer in which the respective monomers are alternately copolymerized).

Examples of the composition containing both a portion having a high affinity for PS and a portion having a high affinity for PMMA include a resin composition obtained by polymerizing at least a monomer having an aromatic ring and a monomer having a substituent with high polarity. Examples of the monomer having an aromatic ring include a monomer having a group in which one hydrogen atom has been removed from the ring of an aromatic hydrocarbon, such as a phenyl group, a biphenyl group, a fluorenyl group, a naphthyl group, an anthryl group or a phenanthryl group, or a monomer having a hetero aryl group such as the aforementioned group in which part of the carbon atoms constituting the ring of the group has been substituted with a hetero atom such as an oxygen atom, a sulfur atom or a nitrogen atom. Examples of the monomer having a substituent with high polarity include a monomer having a trimethoxysilyl group, a trichlorosilyl group, a carboxy group, a hydroxy group, a cyano group or a hydroxyalkyl group in which part of the hydrogen atoms of the alkyl group has been substituted with fluorine atoms.

Examples of the compound containing both a portion having a high affinity for PS and a portion having a high affinity for PMMA include a compound having both an aryl group such as a phenethyltrichlorosilane and a substituent with high polarity, and a compound having both an alkyl group and a substituent with high polarity, such as an alkylsilane compound.

<Formation of Guide Pattern 1>

On the surface of the substrate, before forming a layer containing the block copolymer, a guide pattern having a predetermined pattern may be formed in advance. As a result, it becomes possible to control the arrangement of the phase separation structure, depending on the shape and surface properties of the guide pattern. For example, in the case of a block copolymer where a random fingerprint-patterned phase separation structure is formed without using a guide pattern, by introducing a trench pattern of a resist film on the surface of the substrate, a phase separation structure arranged along the trench can be obtained. The guide pattern can be introduced in accordance with the above-described principle. Further, when the surface of the guide pattern has affinity for any of the polymers constituting the block copolymer, a phase separation structure having a lamellar structure or a cylinder structure arranged in the perpendicular direction of the surface of the substrate can be more reliably formed.

As a substrate provided with a guide pattern on the surface thereof, a substrate having a metal pattern formed in advance can be used. Alternatively, a substrate having a pattern formed on the surface thereof by a lithography method or an imprint method can be used. Among these, a substrate using the lithography method is preferable. For example, a film composed of a resist composition which has affinity for any of the polymers constituting the block copolymer is formed on the surface of the substrate. Then, a selective exposure is conducted using a radial ray such as light or electron beam through a mask pattern having a predetermined pattern, followed by a development treatment, thereby forming a guide pattern. When the substrate is subjected to a neutralization treatment, it is preferable to form a guide pattern on the surface of the neutralized film.

More specifically, for example, a resist composition is applied to the surface of the substrate using a spinner or the like, and a prebake (post applied bake (PAB)) is conducted under temperature conditions of 80 to 150° C. for 40 to 120 seconds, preferably 60 to 90 seconds to form a resist film. Then, for example, using an ArF exposure apparatus or the like, the resist film is selectively exposed to an ArF excimer laser through a desired mask pattern, followed by post exposure bake (PEB) under temperature conditions of 80 to 150° C. for 40 to 120 seconds, preferably 60 to 90 seconds. Subsequently, a developing treatment is conducted using an alkali developing solution such as a 0.1 to 10% by weight aqueous solution of tetramethylammonium hydroxide (TMAH), preferably followed by rinsing with pure water, and drying. If desired, bake treatment (post bake) can be conducted following the developing treatment. In this manner, a guide pattern that is faithful to the mask pattern can be formed.

The height of the guide pattern from the surface of the substrate (or the surface of the neutralization film) is preferably at least as large as the thickness of the layer containing the block copolymer which is formed on the surface of the substrate. The height of the guide pattern from the surface of the substrate (or the surface of the neutralization film) can be appropriately adjusted by the film thickness of the resist film formed by applying the resist composition for forming a guide pattern.

The resist composition for forming the guide pattern can be appropriately selected from resist compositions or a modified product thereof typically used for forming a resist pattern which have affinity for any of the polymers constituting the block copolymer. As the resist composition, a positive resist composition or a negative resist composition may be used, but a negative resist composition is preferable.

When an organic solvent solution of the block copolymer is cast onto the surface of the substrate having a guide pattern formed, and a heat treatment is conducted to cause a phase separation. Therefore, the resist pattern for forming a guide pattern is preferably capable of forming a resist film which exhibits solvent resistance and heat resistance.

<Formation of Guide Pattern 2>

Instead of the aforementioned guide pattern having a structure with physical unevenness, a planar guide pattern may be formed. Specifically, a guide pattern which has regions having affinity for any of the polymers constituting the block copolymer and other regions can be used.

A planar guide pattern can be formed, for example, as follows. Firstly, as a base material, a photosensitive resist composition which has affinity for any of the polymers constituting the block copolymer or a composition in which polymerization or cleavage of the main chain is caused by electron beam is used, and the base material is applied to the surface of the substrate to form a resist pattern. Then, selective exposure is conducted using a radial ray such as light or electron beam through a mask pattern having a predetermined pattern, followed by a development treatment, thereby forming a predetermined pattern of a thin film which has affinity for any of the polymers constituting the block copolymer on the surface of the substrate. In this manner, a planar guide pattern in which regions composed of the base material and regions having the base material removed are arranged with a predetermined pattern can be formed.

The base material for forming such a guide pattern can be appropriately selected from conventional photosensitive resin compositions used for forming a thin film and having the desired characteristics.

<Formation of Phase Separation Structure of the Layer Containing the Block Copolymer>

Firstly, a layer containing the block copolymer is formed on the surface of the substrate. More specifically, the block copolymer dissolved in a suitable organic solvent is applied to the surface of the substrate using a spinner or the like.

As the organic solvent for dissolving the block copolymer, any organic solvent which is capable of dissolving the block copolymer to be used and forming a uniform solution can be used, and an organic solvent having high compatibility with all of the polymers constituting the block copolymer can be used. As the organic solvent, one type of solvent can be used, or two or more types may be used in combination.

Examples of the organic solvent for dissolving the block copolymer include lactones such as γ-butyrolactone; ketones such as acetone, methyl ethyl ketone, cyclohexanone, methyl-n-pentyl ketone, methyl isopentyl ketone, and 2-heptanone; polyhydric alcohols, such as ethylene glycol, diethylene glycol, propylene glycol and dipropylene glycol; compounds having an ester bond, such as ethylene glycol monoacetate, diethylene glycol monoacetate, propylene glycol monoacetate, and dipropylene glycol monoacetate; polyhydric alcohol derivatives including compounds having an ether bond, such as a monoalkylether (e.g., monomethylether, monoethylether, monopropylether or monobutylether) or monophenylether of any of these polyhydric alcohols or compounds having an ester bond (among these, propylene glycol monomethyl ether acetate (PGMEA) and propylene glycol monomethyl ether (PGME) are preferable); cyclic ethers such as dioxane; esters such as methyl lactate, ethyl lactate (EL), methyl acetate, ethyl acetate, butyl acetate, methyl pyruvate, ethyl pyruvate, methyl methoxypropionate, and ethyl ethoxypropionate; and aromatic organic solvents such as anisole, ethylbenzylether, cresylmethylether, diphenylether, dibenzylether, phenetole, butylphenylether, ethylbenzene, diethylbenzene, pentylbenzene, isopropylbenzene, toluene, xylene, cymene and mesitylene.

For example, when a PS-PMMA block copolymer is used as the block copolymer, it is preferable to dissolve the block copolymer in an aromatic organic solvent such as toluene.

The thickness of the layer containing the block copolymer which is formed on the surface of the substrate can be appropriately adjusted such that it becomes larger than the height of the metal nanostructure to be formed from the surface of the substrate.

In the present invention, the lower limit of the thickness of the layer containing the block copolymer is not particularly limited, as long as it is sufficient for causing phase separation. In consideration of the strength of the metal nanostructure and the uniformity of the substrate having the metal nanostructure formed, the thickness of the layer is preferably 5 nm or more, and more preferably 10 nm or more.

The substrate having the layer containing the block copolymer formed is subjected to a heat treatment, and a phase separation structure in which at least a part of the surface of the substrate is exposed is formed by a selective removal of the block copolymer in a later step. The heat treatment is preferably conducted at a temperature at least as high as the glass transition temperature of the block copolymer used and lower than the heat decomposition temperature. Further, the heat treatment is preferably conducted in a low reactive gas such as nitrogen.

<Selective Removal of Phase of Polymer $P_B$ in Phase Separation Structure>

Subsequently, after the formation of the phase separation structure, the phase of polymer $P_B$ exposed is selectively removed from the layer containing the block copolymer formed on the substrate. As a result, only the phase of the polymer $P_A$ remains on the exposed surface of the substrate. Further, the phase of the polymer $P_B$ which was continuously formed from the surface of the substrate to the surface of the layer containing the block copolymer is removed, so that the surface of the substrate is exposed.

The selective removal treatment is not particularly limited, as long as it is a treatment capable of decomposing and removing the polymer $P_B$ without affecting the polymer $P_A$. The selective removal treatment can be appropriately selected from any methods for removing a resin film, depending on the types of the polymer $P_A$ and the polymer $P_B$. Further, when a neutralization film is formed on the surface of the substrate in advance, the neutralization film is removed together with the phase of the polymer $P_B$. Furthermore, when a guide pattern is formed on the surface of the substrate in advance, like the polymer $P_A$, the guide pattern is not removed. Examples of the removal treatment include an oxygen plasma treatment, an ozone treatment, a UV irradiation treatment, a heat decomposition treatment and a chemical decomposition treatment.

After the selective removal treatment and before the formation of a metal nanostructure, the exposed surface of the substrate may be subjected to a washing treatment. As the washing treatment, the same treatments as those described above can be used.

<Formation of Metal Nanostructure>

The exposed surface of the substrate is allowed to come into contact with a metal ion to effect an electrochemical reaction between the surface of the substrate and the metal ion, thereby depositing a metal on the surface of the substrate. The layer containing the block copolymer remaining on the surface of the substrate (i.e., a phase composed of polymer $P_A$ on the surface) functions as a template, and a metal nanostructure is formed from the deposited metal.

When the phase separation structure is a lamellar structure or a cylinder structure arranged in a perpendicular direction of the surface of the substrate, by selectively removing the phase of the polymer $P_B$, a line or a hole structure composed of only the polymer $P_A$ is formed on the substrate. By using the structure composed of only the polymer $P_A$ as a template, a linear or cylindrical metal nanostructure can be directly formed on the substrate.

The metal ion is not particularly limited as long as it has a standard electrode potential larger than that of the metal contained in the substrate. Examples of the metal ion include ions of gold, silver, copper, nickel, cobalt, tin and platinum group metals (palladium, platinum, rhodium and ruthenium). Among these, when a silicon wafer is used as the substrate, the metal ion is preferably a gold ion, a silver ion or a copper ion.

More specifically, the substrate having a part of the surface exposed is immersed in an aqueous solution containing the metal ion. The immersion time in the aqueous metal solution can be appropriately adjusted, taking into consideration of the area of the exposed surface of the substrate, the height and size of the desired metal nanostructure, and the like. When the immersion time in the aqueous metal solution is too short, a region where the metal is not deposited is formed on part of the exposed surface of the substrate, so that the shape of the formed metal nanostructure is not exactly the same as the shape of the phase of the polymer $P_B$ which has been selectively removed. On the other hand, when the immersion time is too long, the metal is deposited outside the template, so that a metal nanostructure having the same shape as that of the phase of the polymer $P_B$ which has been selectively removed cannot be formed.

The substrate having the metal nanostructure formed can be directly used, or the layer containing the block copolymer (such as the phase of the polymer $P_A$) remaining on the surface of the substrate can be removed. For example, by subjecting the substrate having the metal nanostructure formed to a hydrogen plasma treatment, the phase of the polymer $P_A$ and the like can be removed.

<<Metal Nanostructure-containing Substrate>>

The substrate provided with a metal nanostructure on the surface thereof according to the present invention (the metal nanostructure-containing substrate according to the present invention) is a substrate produced by the method of producing a substrate provided with a metal nanostructure on the surface thereof according to the present invention, and is a film having a metal nanostructure on the surface of the substrate. Since the metal nanostructure is formed by depositing the metal directly on the surface of the substrate, when the metal nanostructure is used in a chemical sensor or an optical sensor, it exhibits an excellent sensitivity as compared to s substrate provided with a metal nanostructure having a protection film (such as a resin film) adhered thereto.

The shape of the metal nanostructure formed on the substrate is not particularly limited. For example, a linear shape, a cylindrical shape, or any other three-dimensional structure, a network structure thereof, a complex structure, or a recurring structure can be adopted.

The substrate may have 1 metal nanostructure, or a plurality of metal nanostructures. When the substrate has a plurality of metal nanostructures, the arrangement of the metal nanostructures is not particularly limited. The metal nanostructures may be arranged in a radial manner, a grid-like manner, or a random manner (e.g., banded structure).

Since a metal exhibits excellent eletroconductivity and thermal conductivity, for example, by appropriately arranging the metal nanostructure on the substrate, a metal nanostructure-containing substrate exhibiting an excellent anisotropy in which heat and electricity is conducted only in a specific direction of the substrate can be obtained. This is due to the fact that, in the substrate, heat and electricity is conducted only through the metal nanostructure as the medium.

Specifically, for example, by arranging a plurality of linear metal nanostructures on the substrate in parallel, an anisotropic substrate having an electroconductivity anisotropy or a heat conductivity anisotropy can be obtained in which heat or electricity is conducted in a direction parallel to the metal nanostructure on the substrate, but not in a direction perpendicular to the metal nanostructure.

EXAMPLES

As follows is a description of examples of the present invention, although the scope of the present invention is by no way limited by these examples.

Example 1

A silicon substrate was immersed in a sulfuric acid/oxygenated water mixed solution (volume ratio: 7:3) for 1 hour, and the substrate was washed with water, followed by air-drying with a nitrogen gas. Then, the substrate was immersed in a toluene solution of phenethyltrichlorosilane (0.05 volume %) for 10 minutes, and washed with toluene, followed by air-drying with a nitrogen gas.

To the substrate, a toluene solution of a PS-PMMA block copolymer 1 (15 mg/ml) (molecular weight of PS: 53,000, molecular weight of PMMA: 54,000, polydispersity index (PDI): 1.16) was spin-coated (number of revolution: 3,000 rpm, 30 seconds). Then, the substrate having the PS-PMMA block copolymer coated thereon was heated at 200° C. for 3 hours while flowing nitrogen, thereby forming a phase separation structure. Thereafter, the substrate was subjected to an oxygen plasma treatment (10 sccm, 10 Pa, 70 W, 18 seconds) to selectively remove the phase of PMMA. As a result, only the phase of PS remained on the substrate, and only part of the surface of the substrate where the phase of PMMA was formed was exposed. Further, the substrate was immersed in a silver nitrate ($AgNO_3$) (0.5 mM)/hydrogen fluoride (HF) (4.8M) mixed aqueous solution for 3 minutes, thereby forming a silver nanostructure on the surface of the substrate.

The results obtained by observing the surface of the obtained substrate using a scanning electron microscope is shown in FIG. 1. The figure on the left-hand side of FIG. 1 shows an electron microscope image of the surface of the substrate after the removal treatment of PMMA. It was confirmed that the linear phase of PS formed a band structure. Further, the figure on the right-hand side of FIG. 1 shows an electron microscope image of the surface of the substrate after the immersion treatment in the silver nitrate/hydrogen fluoride mixed aqueous solution (after introduction of silver). It was confirmed that silver was deposited on the band-structure template of PS (between the lines of PS)

From these results, it is apparent that silver nano particles were selectively deposited and generated on the surface of the silicon substrate where PMMA was removed and exposed.

Example 2

A silver nanostructure was formed on the surface of a silicon substrate in the same manner as in Example 1, except that the immersion treatment time in the silver nitrate/hydrogen fluoride mixed aqueous solution was changed to 1 minute, 2 minutes or 3 minutes.

Figure 2:
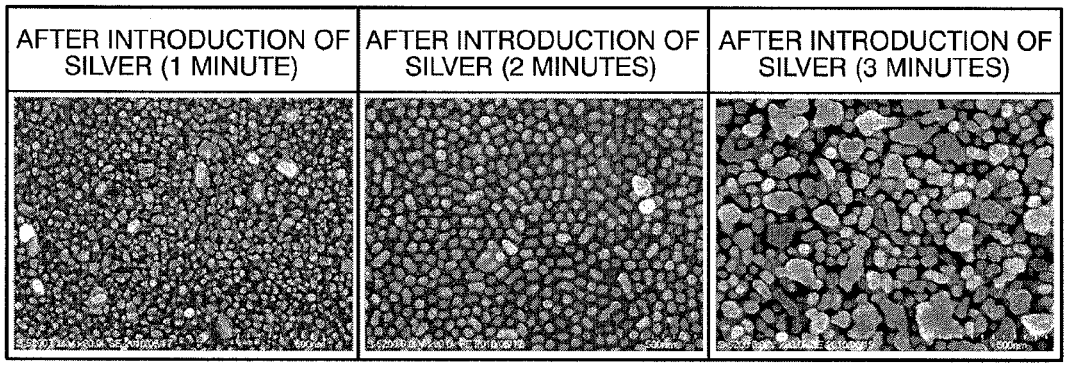
FIG. 2 is a scanning electron microscope image of the surface of the silicon wafer in Example 2.

The results obtained by observing the surface of the obtained substrate after the immersion treatment in the silver nitrate/hydrogen fluoride mixed aqueous solution (after the introduction of silver) using a scanning electron microscope is shown in FIG. 2. The figures on the left-hand side, the middle and the right had-side of FIG. 2 respectively show the electron microscope images of the case where the immersion treatment time in the silver nitrate/hydrogen fluoride mixed aqueous solution was 1 minute, the case where the immersion treatment time was 2 minutes, and the case where the immersion treatment time was 3 minutes. From these results, it is apparent that, the longer the immersion treatment time in the silver solution becomes, the silver particles grow within the trench of the band-structured template of PS, and eventually grows outside the trench of the template.

Example 3

A silicon substrate was immersed in a sulfuric acid/oxygenated water mixed solution (volume ratio: 7:3) for 1 hour, and the substrate was washed with water, followed by air-drying with a nitrogen gas. Then, the substrate was immersed in a toluene solution of phenethyltrichlorosilane (0.05 volume %) for 10 minutes, and washed with toluene, followed by air-drying with a nitrogen gas.

To the substrate, a toluene solution of a PS-PMMA block copolymer 2 (15 mg/ml) (molecular weight of PS: 45,000, molecular weight of PMMA: 20,000, PDI: 1.16) was spin-coated (number of revolution: 3,000 rpm, 30 seconds). Then, the substrate having the PS-PMMA block copolymer coated thereon was heated at 190° C. for 24 hours while flowing nitrogen, thereby forming a phase separation structure. Thereafter, the substrate was subjected to an oxygen plasma treatment (10 sccm, 10 Pa, 70 W, 18 seconds) to selectively remove the phase of PMMA. As a result, only the phase of PS remained on the substrate, and only part of the surface of the substrate where the phase of PMMA was formed was exposed. Further, the substrate was immersed in a silver nitrate (0.5 mM)/hydrogen fluoride (4.8M) mixed aqueous solution for 1 minute, 2 minutes or 3 minutes, thereby forming a silver nanostructure on the surface of the substrate.

Figure 3:
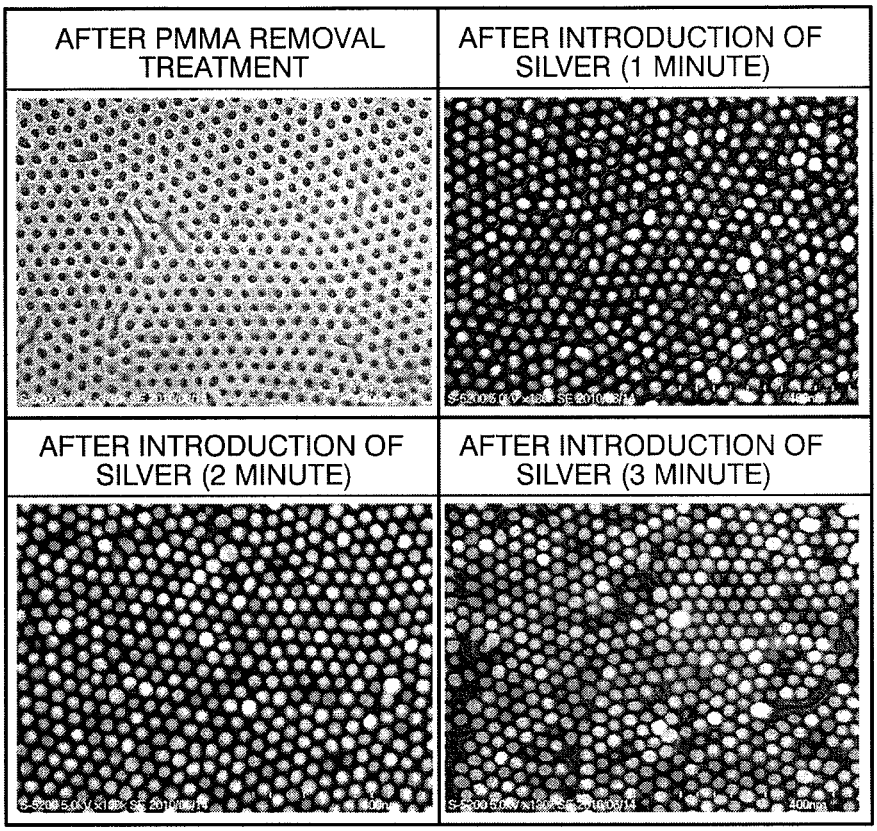
FIG. 3 is a scanning electron microscope image of the surface of the silicon wafer in Example 3.

The results obtained by observing the surface of the obtained substrate using a scanning electron microscope is shown in FIG. 3. The figure on the upper left-hand side of FIG. 3 ("AFTER PMMA REMOVAL TREATMENT") shows an electron microscope image of the surface of the substrate after the removal treatment of PMMA. It was confirmed that a hole structure having a diameter of 23 nm was formed by the phase of PS remaining on the surface of the substrate. The figures on the upper right-hand side ("AFTER INTRODUCTION OF SILVER (1 MINUTE)"), the lower left-hand side ("AFTER INTRODUCTION OF SILVER (2 MINUTES)") and the lower right-hand side ("AFTER INTRODUCTION OF SILVER (3 MINUTES)") of FIG. 3 respectively show the electron microscope images of the case where the immersion treatment time in the silver nitrate/hydrogen fluoride mixed aqueous solution was 1 minute, the case where the immersion treatment time was 2 minutes, and the case where the immersion treatment time was 3 minutes. It was confirmed that silver was deposited in the hole template of PS. In the case where the immersion treatment time was 1 minute, the formed silver nanostructure had a diameter of about 20 nm, and the template holes were not completely filled. In the case where the immersion treatment time was 2 minutes, a cylindrical silver nanostructure having a diameter of 24 nm (which corresponds to the diameter of the template holes) was formed, and each template hole was filled with one silver particle. In the case where the immersion treatment time was 3 minutes, although the diameter of the formed silver nanostructure did not increase from that in the case of the immersion treatment time of 2 minutes, it was observed that the silver particles were growing outside the holes.

Example 4

A silver nanostructure was formed on the surface of a silicon substrate in the same manner as in Example 1, except that the immersion treatment time in the silver nitrate/hydrogen fluoride mixed aqueous solution was changed to 2 minutes or 3 minutes, and a hydrogen plasma treatment was conducted after the immersion treatment under the conditions of 30 sccm, 10 Pa, 50 W or 30 sccm, 10 Pa, 100 W, so as to selectively remove the remaining PS on the surface of the substrate.

Figure 4:
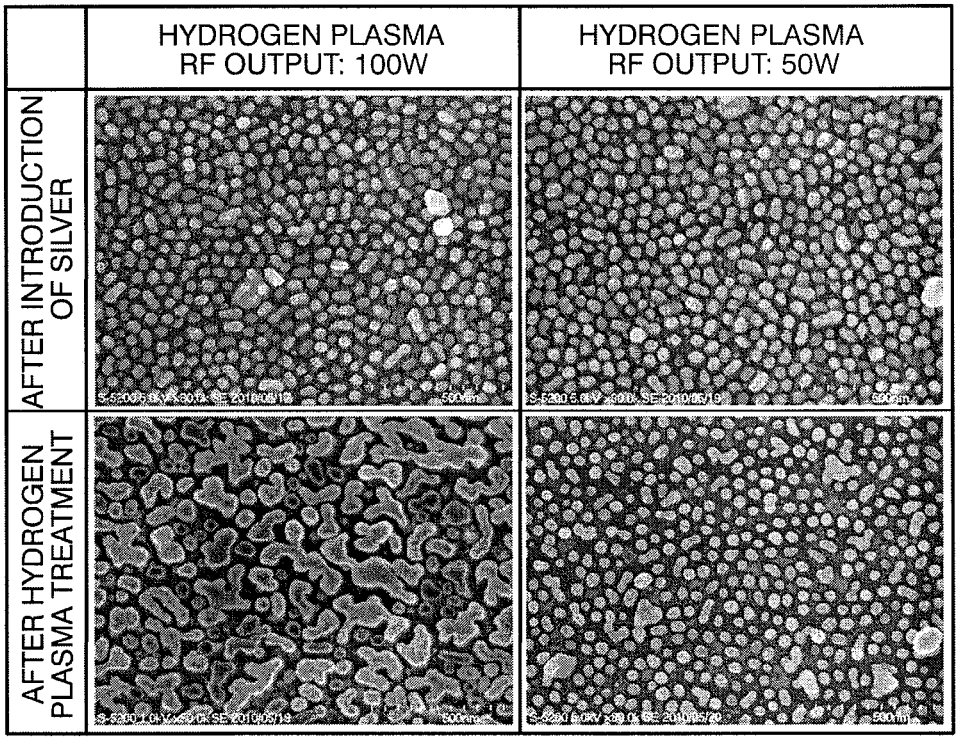
FIG. 4 is a scanning electron microscope image of the surface of the silicon wafer in Example 4.

The results obtained by observing the surface of the obtained substrate using a scanning electron microscope in the case where the immersion treatment time in the silver nitrate/hydrogen fluoride mixed aqueous solution was 3 minutes are shown in FIG. 4. In FIG. 4, the figures on the upper side show the electron microscope images of the surface of the substrate after the immersion treatment in the silver nitrate/hydrogen fluoride mixed aqueous solution (after the introduction of silver). Further, in FIG. 4, the figures on the lower side show the electron microscope images of the surface of the substrate after the hydrogen plasma treatment. Furthermore, in FIG. 4, the figures on the right-hand side ("HYDROGEN PLASMA RF OUTPUT: 50 W") show the electron microscope images of the surface of the substrate in the case where the hydrogen plasma treatment was conducted under the conditions of 30 sccm, 10 Pa, 50 W, and the figures on the left-hand side ("HYDROGEN PLASMA RF OUTPUT: 100 W") show the electron microscope images of the surface of the substrate in the case where the hydrogen plasma treatment was conducted under the conditions of 30 sccm, 10 Pa, 100 W. As a result, the shape of the silver nanostructure hardly changed before and after the hydrogen plasma treatment in the case where the hydrogen plasma treatment was conducted with an output of 50 W. In contrast, in the case where the hydrogen plasma treatment was conducted with an output of 100 W, fusion of mutually adjacent silver particles was caused by the hydrogen plasma treatment, and a structural change in the silver nanostructure was observed. From these results, it is apparent that, by adjusting the output of the hydrogen plasma treatment, only the resin used as the template can be selectively removed, and a silver nanostructure reflecting the template structure can be formed on the surface of the substrate without changing the structure of the silver nanostructure formed by the electrochemical reaction.

Production Example 1

A negative resist composition used as a base material was produced.

Specifically, 100 parts by weight of a polymer represented by formula (A)-1 shown below (Mw=40,000), 2.5 parts by weight of a photoacid generator represented by formula (B)-1 shown below ((4-terphenylthiophenyl)diphenylsulfonium tris(pentafluoroethyl)trifluorophosphate), 150 parts by weight of a cross-linking agent represented by formula (C)-1 shown below and 600 parts by weight of PGMEA were mixed together and dissolved to produce a negative resist composition. In formula (A)-1, the subscript numerals shown on the bottom right of the parentheses ( ) indicate the percentage (mol %) of the respective structural units.

[Chemical Formula 1.]

(A)-1

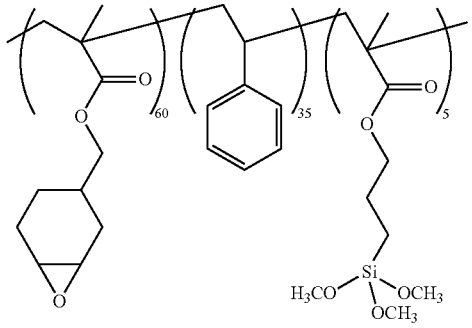

-continued

[Chemical Formula 2.]

(B)-1

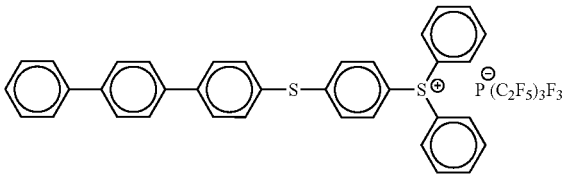

[Chemical Formula 3.]

(C)-1

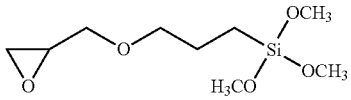

Example 5

A silicon substrate was immersed in a sulfuric acid/oxygenated water mixed solution (volume ratio: 7:3) for 1 hour, and the substrate was washed with water, followed by air-drying with a nitrogen gas. Then, on the surface of the substrate, the negative resist composition produced in Production Example 1 was spin-coated (number of revolution: 1,000 rpm, 60 seconds), and heated at 120° C. for 60 seconds. A treatment in which the substrate was immersed in PGMEA for 1 minute was conducted twice, and further washed with PGMEA, followed by air-drying with a nitrogen gas.

To the substrate, the toluene solution of PS-PMMA block copolymer 1 used in Example 1 (15 mg/ml) or the toluene solution of PS-PMMA block copolymer 2 used in Example 3 (15 mg/ml) was spin-coated (number of revolution: 3,000 rpm, 30 seconds). The substrate having the PS-PMMA block copolymer 1 coated thereon was heated at 200° C. for 3 hours while flowing nitrogen, and the substrate having the PS-PMMA block copolymer 2 coated thereon was heated at 190° C. for 24 hours while flowing nitrogen, thereby forming phase separation structures. Thereafter, each substrate was subjected to an oxygen plasma treatment (10 sccm, 10 Pa, 70 W, 18 seconds) to selectively remove the phase of PMMA. Further, each substrate was immersed in a tetrachloroauric (III) acid ($HAuCl_4$) (0.5 mM)/hydrogen fluoride (0.48 M) mixed aqueous solution for 1 minute, thereby forming a gold nanostructure on the surface of the substrate.

Figure 5:
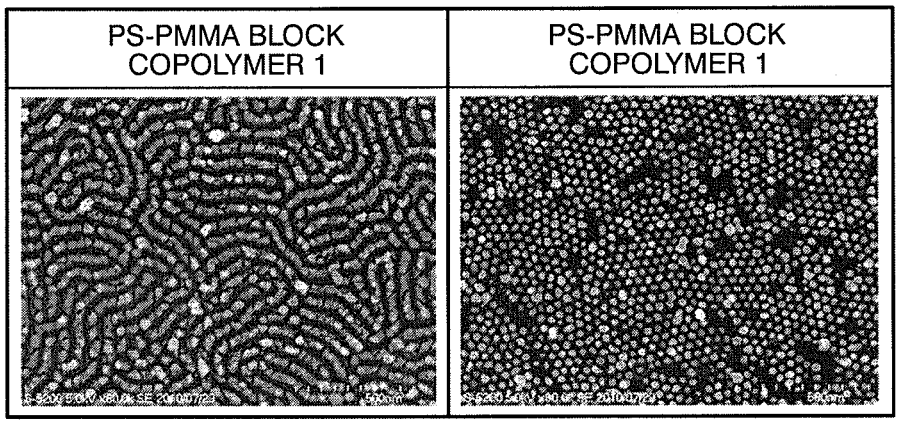
FIG. 5 is a scanning electron microscope image of the surface of the silicon wafer in Example 5.

The results obtained by observing the surface of the obtained substrates using a scanning electron microscope are shown in FIG. 5. The figure on the left-hand side of FIG. 5 shows an electron microscope image of the surface of the substrate coated with PS-PMMA block copolymer 1. It was confirmed that gold was deposited in the trench of the band-structured template of PS. The figure on the right-hand side of FIG. 5 shows an electron microscope image of the surface of the substrate coated with PS-PMMA block copolymer 2. It was confirmed that gold was deposited in the template holes of PS. From these results, like in the case of silver, it is apparent that a gold nanostructure reflecting the template structure of PS can be formed on the surface of the silicon substrate exposed by selectively removing PMMA.

Example 6

A silicon substrate was immersed in a sulfuric acid/oxygenated water mixed solution (volume ratio: 7:3) for 1 hour, and the substrate was washed with water, followed by air-drying with a nitrogen gas. Then, on the surface of the substrate, the negative resist composition produced in Production Example 1 was spin-coated (number of revolution: 1,000 rpm, 60 seconds), and heated at 120° C. for 60 seconds. A treatment in which the substrate was immersed in PGMEA for 1 minute was conducted twice, and further washed with PGMEA, followed by air-drying with a nitrogen gas.

To the substrate, the toluene solution of PS-PMMA block copolymer 1 used in Example 1 (15 mg/ml) was spin-coated (number of revolution: 3,000 rpm, 30 seconds), followed by heating at 190° C. for 24 hours while flowing nitrogen, thereby forming a phase separation structure. Thereafter, the substrate was subjected to an oxygen plasma treatment (10 sccm, 10 Pa, 70 W, 18 seconds) to selectively remove the phase of PMMA. Further, the substrate was immersed in a copper nitrate ($Cu(NO_3)_2$) (5 mM)/hydrogen fluoride (0.48 M) mixed aqueous solution for 1 minute, thereby forming a copper nanostructure on the surface of the substrate.

Figure 6:
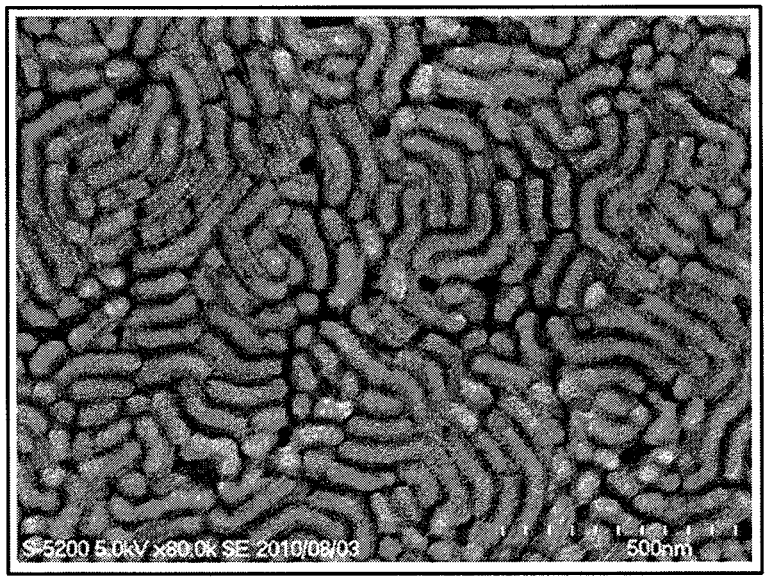
FIG. 6 is a scanning electron microscope image of the surface of the silicon wafer in Example 6.

The result obtained by observing the surface of the obtained substrate using a scanning electron microscope is shown in FIG. 6. As a result, it was confirmed that copper was deposited in the trench of the band-structured template of PS. From the result, like in the case of silver, it is apparent that a copper nanostructure reflecting the template structure of PS can be formed on the surface of the silicon substrate exposed by selectively removing PMMA.

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

What is claimed is:

1. A method of producing a substrate provided with a metal nanostructure on the surface thereof, comprising:

heating and polymerizing a heat-polymerizable resin composition to form a base material layer on a surface of a substrate, forming a layer comprising a block copolymer having a plurality of polymers bonded on the base material layer, subjecting the layer comprising the block copolymer to phase separation, and forming a lamellar structure arranged in a perpendicular direction to the surface of the substrate, selectively removing a phase of at least one polymer of the plurality of copolymers constituting the block copolymer from the layer to remove at least a portion of each of the base material layer and the block copolymer layer and expose part of the surface of the substrate to form a band structure, and allowing a metal ion to come into contact with the exposed surface of the substrate using the band structure as a template to effect an electrochemical reaction between the surface of the substrate and the metal ion, thereby depositing a metal on the surface of the substrate, wherein the heat-polymerizable resin composition is obtained by polymerizing at least a monomer having an aromatic ring and a monomer having a substituent, the monomer having an aromatic ring is a monomer having a group in which one hydrogen atom has been removed from a phenyl group, a biphenyl group, a fluorenyl group, a naphthyl group, an anthryl group or a phenanthryl group, or a monomer having the aforementioned group in which part of the carbon atoms constituting the ring of the group has been substituted with a hetero atom, and the block copolymer comprises polystyrene and polymethyl methacrylate.

2. The method according to claim 1, wherein the metal ion is a gold ion, a silver ion or a copper ion.

3. The method according to claim 1, wherein the monomer that has the substituent is a monomer having a trimethoxysilyl group, a trichlorosilyl group, a carboxy group, a hydroxy group, a cyano group or a hydroxyalkyl group in which part of the hydrogen atoms of the alkyl group has been substituted with fluorine atoms.

* * * * *